US011788730B2

(12) United States Patent
Daufenbach et al.

(10) Patent No.: US 11,788,730 B2
(45) Date of Patent: Oct. 17, 2023

(54) KNOB MECHANISM FOR GAS COOKTOP

(71) Applicant: WHIRLPOOL CORPORATION, Benton Harbor, MI (US)

(72) Inventors: Rhony Cristian Daufenbach, Joinville (BR); Rodrigo Schultz, Joinville (BR); Rodrigo Tamanini, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 8 days.

(21) Appl. No.: 17/681,222

(22) Filed: Feb. 25, 2022

(65) Prior Publication Data

US 2023/0272915 A1 Aug. 31, 2023

(51) Int. Cl.
*F24C 3/12* (2006.01)
*F23N 1/00* (2006.01)

(52) U.S. Cl.
CPC ..... *F24C 3/126* (2013.01); *F23N 1/007* (2013.01); *F23N 2237/00* (2020.01); *F23N 2241/08* (2020.01)

(58) Field of Classification Search
CPC ..... F24C 3/128; F24C 3/126; F24C 3/124; F24C 3/12
USPC ..... 126/39 R, 39 E
See application file for complete search history.

(56) References Cited

U.S. PATENT DOCUMENTS

| | | | | |
|---|---|---|---|---|
| 2,829,538 | A | 2/1953 | Mueller | |
| 4,300,525 | A | 11/1981 | Delgado et al. | |
| 5,165,654 | A * | 11/1992 | Liu | F16K 31/5284 251/263 |
| 8,899,264 | B2 | 12/2014 | Young et al. | |

FOREIGN PATENT DOCUMENTS

| | | |
|---|---|---|
| EP | 0283449 B1 | 8/1991 |
| EP | 2604923 B1 | 3/2016 |
| EP | 3058277 B1 | 12/2017 |
| GB | 1258576 A | 12/1971 |

* cited by examiner

*Primary Examiner* — Vivek K Shirsat
(74) *Attorney, Agent, or Firm* — Brooks Kushman, P.C.

(57) ABSTRACT

A knob assembly for a gas cooktop may include a knob configured to control a flow of gas from a burner of a cooktop starting at a resting position, the knob defining a hollow interior and having a support cylinder extending vertically through the hollow interior, wherein the support cylinder includes a projection flap protruding therefrom, an inner lock ring arranged at least partially within the hollow interior of the knob and having a chamfered region defining a ring opening adjacent an inclined portion, where the opening is configured to selectively receive the projection flap in response to depression of the knob and where the projection flap slides along the inclined portion in response to subsequent rotation of the knob, the inclined portion imparting frictional resistance on the projection flap to prevent against unintentional rotation of the knob.

20 Claims, 6 Drawing Sheets

KNOB MECHANISM FOR GAS COOKTOP

TECHNICAL FIELD

Described herein are hinge systems for a knob mechanism for gas cooktops.

BACKGROUND

A cooking appliance is used to cook meals and other foodstuffs on a cooktop or within an oven. The cooking appliance typically includes various control switches and electronics to control the heating elements of the cooking appliance.

SUMMARY

A knob assembly for a gas cooktop may include a knob configured to control a flow of gas from a burner of a cooktop starting at a resting position, the knob defining a hollow interior and having a support cylinder extending vertically through the hollow interior, wherein the support cylinder includes a projection flap protruding therefrom, an inner lock ring arranged at least partially within the hollow interior of the knob and having a chamfered region defining a ring opening adjacent an inclined portion, where the opening is configured to selectively receive the projection flap in response to depression of the knob and where the projection flap slides along the inclined portion in response to subsequent rotation of the knob, the inclined portion imparting frictional resistance on the projection flap to prevent against unintentional rotation of the knob.

A knob assembly for a gas cooktop may include a knob configured to control a flow of gas from a burner of a cooktop starting at a resting position, the knob defining a hollow interior and a projection flap protruding therefrom, the projection flap configured to move vertically and rotationally with the knob, and an inner lock ring arranged at least partially within the hollow interior of the knob and having a chamfered region defining a ring opening adjacent an inclined portion, the opening configured to selectively receive the projection flap in response to depression of the knob and where the projection flap slides along the inclined portion in response to subsequent rotation of the knob, the inclined portion creating an intermediate position for the knob to prevent against unintentional rotation of the knob.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Knobs in gas cooktops and freestanding ranges are often sensitive to actuation and may be accidentally turned on. While not intended, such accidental actuations or rotations may release gas unknowingly. As described in detail herein, an improved system allows for a resistance to be applied to the actuation during the start of the rotation of the knob assembly. This resistance may ensure that any release of gas is in response to actuations that are deliberate and not accidental.

The system may include a knob assembly including a knob, cover, inner lock ring, spring, and bezel. The knob may include a projection flap configured to engage the inner lock ring when the knob is rotated to an intermediate position. In this position, the projection flap on the knob may engage the inner lock ring and cause the inner lock ring to rotate with the knob. Up until this intermediate position, the spring may bias the knob into a resting position, forcing the knob to return to its normal position. However, once the knob is rotated so that the projection flap engages with a chamfered region of the inner lock ring, the spring bias is released and the knob may rotate freely.

Thus, if the rotation was accidental, the spring will impart a force to return the knob back to the normal or resting position. If the rotation was done on purpose by a user, the user will continue to fight against the resistance and rotate the knob until the projection flap engages the inner lock ring and the spark starts to produce a sound and gas is flowing to the burner. After rotating past the intermediate position, the knob may move freely to allow the user to select the desired position of the knob for the desired gas flow. This prevents the knob from leaving its initial position and releasing gas without the spark.

Figure 1:
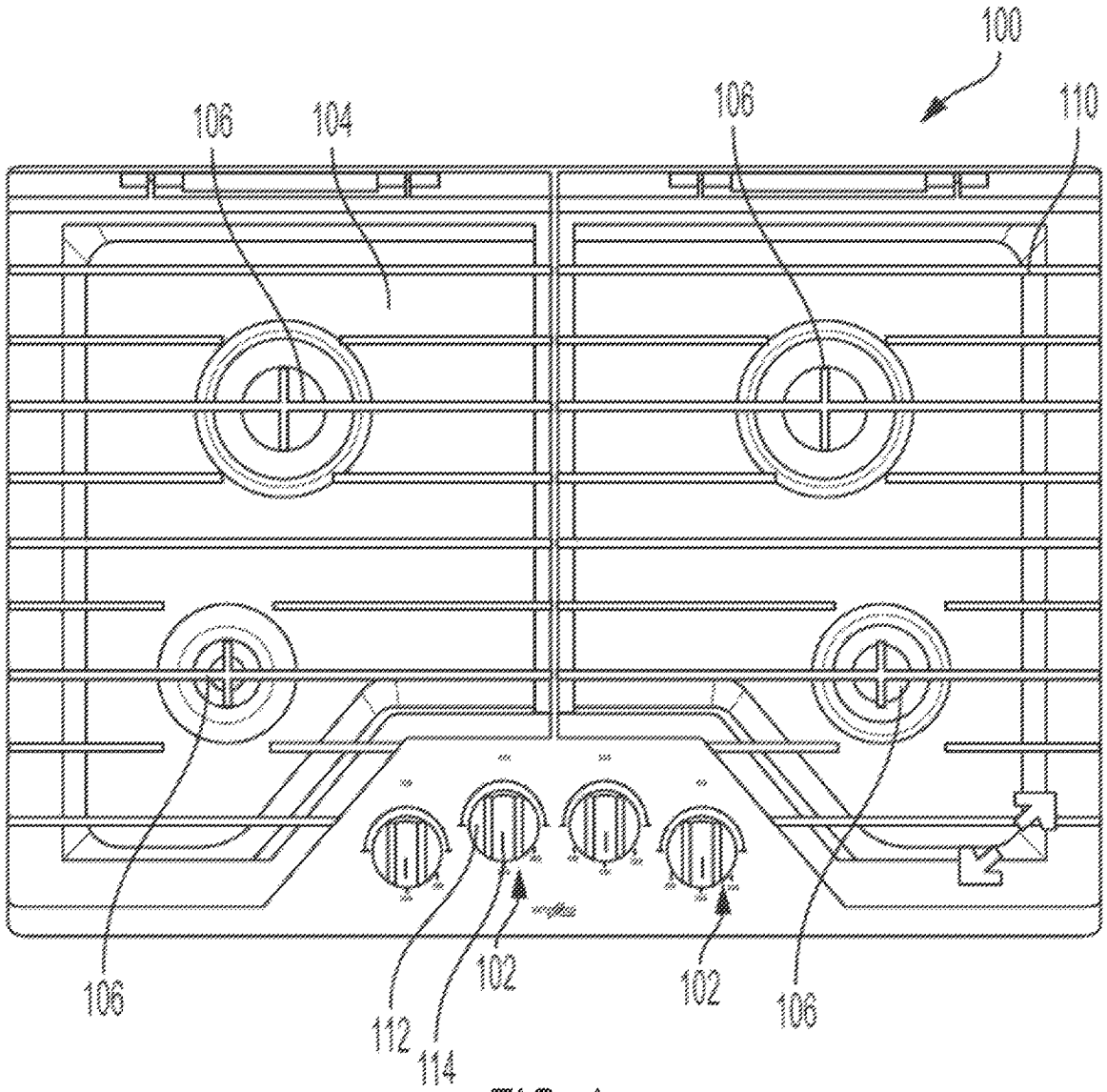
FIG. 1 illustrates an example cooktop, such as a gas cooktop.

FIG. 1 illustrates an example cooktop 100, such as a gas range assembly. The cooktop 100 may include a cooking area 104 having a plurality of burners 106, each controlled by a knob 102. Each separately controlled burner 106 is dedicated to supplying heat to that area of the cooking area 104. The heat supplied to each separately controlled heating area is controlled such that a command to change the heat supplied to it may not change the amount of heat supplied to any other separately controlled cooking area 104. In the example of FIG. 1, the cooktop 100 has four separately controlled cooking areas 104, but more or fewer cooking areas 104 may be included.

One or more grates 110 may be arranged above the cooking area 104 in order to maintain cookware thereon a predefined distance above the burners 106. Each grate 110 may be made of metal, iron, or some other thermally conductive element. Each burner 106 may be operable to heat to desired cooking temperatures. In an example, each knob 102 is configured to control the flow of gas to a respective one of the burners 106. The knobs 102 may be labeled to allow a user to identify which knob 102 controls which of the burners 106. The burners 106 are configured to generate controlled flames that may be used to heat cookware arranged on the grate 110. The magnitude of the flame generated by the burners 106 is proportionate to the amount of gas flowing to the burners 106. A user may adjust the flow of gas to the burners 106 using the knobs 102. As the user rotates each of the knobs 102, a gas control valve (not shown) changes the amount of gas flowing to the corresponding burner 106.

While the knobs 102 in the example of FIG. 1 are illustrated as being arranged on top of the cooking area 104, the knobs may also be arranged on a front surface of a manifold of the cooktop 100. The knobs 102 may include markings therearound to indicate a certain level of heat being supplied by the burner 106 relative to the rotational position of the knob 102. For example, markings associated with a high, medium, low, simmer settings may be included. Each knob 102 has a face 112 with a grip 114 extending outwardly from the face 112. It should be appreciated that in other embodiments each knob 102 may be contemplated, such as the knob 102 being shaped as a cylinder or oval without a grip.

Figure 2:
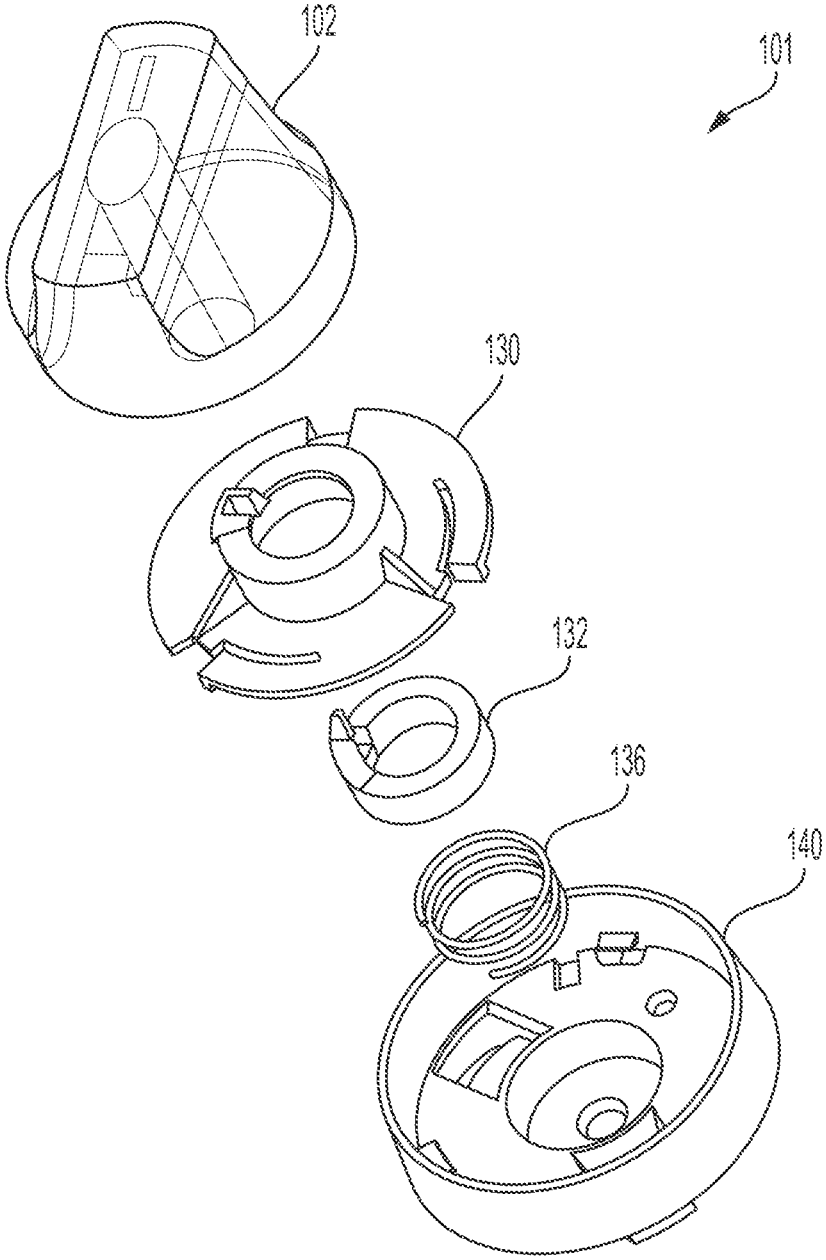
FIG. 2 illustrates an exploded view of an example knob assembly of the cooktop of FIG. 1.

FIG. 2 illustrates an exploded view of an example knob assembly 101 of the cooktop 100 of FIG. 1. The knob assembly 101 may include the knob 102, cover 130, inner lock ring 132, spring 134 and bezel 140.

Figure 3:
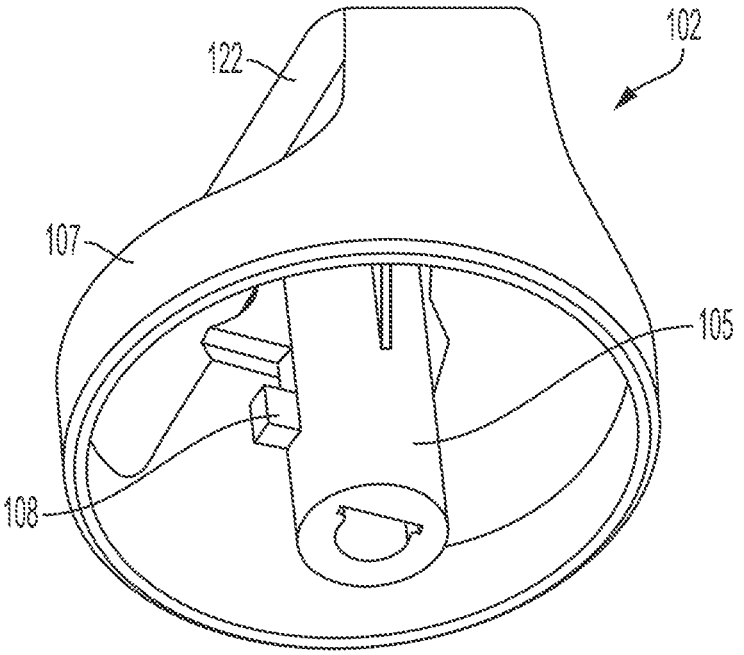
FIG. 3 illustrates a perspective view of a knob of the knob assembly.

FIG. 3 illustrates a perspective view of the knob 102 of the knob assembly 101. In the assembled state, the knob 102 may be received by the bezel 140. The spring 134 may bias the knob at a first position. The knob 102 may include an interface 122 configured to engage with the user's fingers to apply pressure to rotate and actuate the knob 102. The interface 122 may also indicate a rotational location of the knob 102, thus indicate the flow level of gas such as high, medium, low, etc. When a user applies pressure to the knob 102, the knob 102 may be pushed downward into the bezel 140 and subsequently rotated.

The knob 102 may define a hollow interior. A support cylinder 105 may extend from the underside of the interface 122 through the inside center of the knob 102. The cylinder 105 may form a hollow opening having a generally cylindrical shape and a flat side. The cylinder 105 may be configured to receive a post during assembly of the knob assembly 101 onto the cooktop 100.

A projection flap 108 may be arranged on the exterior of the cylinder 105 and within the hollow underside of the knob 102. The projection flap 108 may form a cuboid, cube, or rectangular prism. The projection flap 108 may extend out at one side of the cylinder and be configured to engage with portions of the cover 130 and inner lock ring 132.

Figure 4:
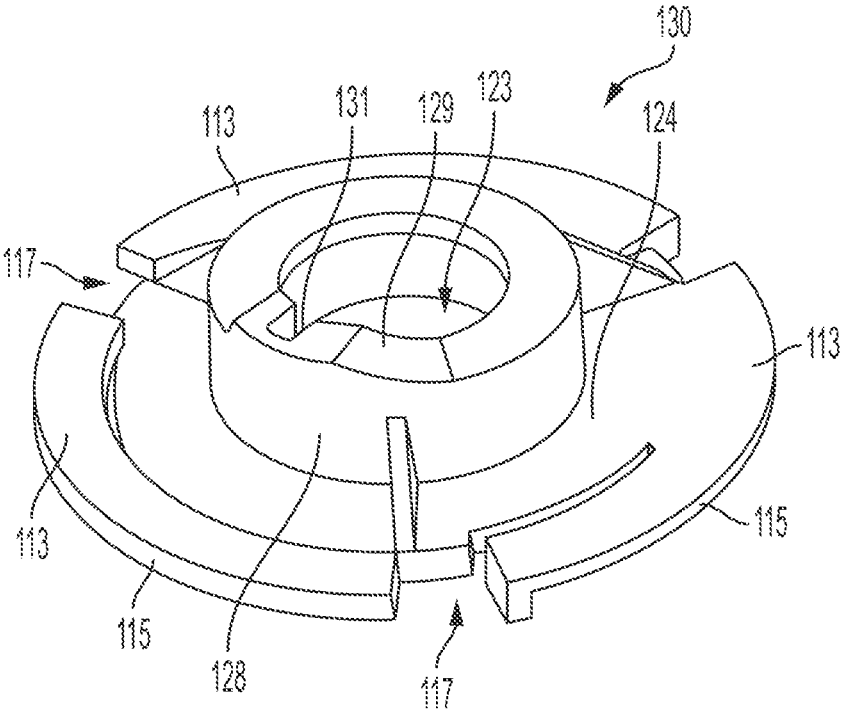
FIG. 4 illustrates a perspective view of an example cover of the knob assembly.

FIG. 4 illustrates a perspective view of the example cover 130 of the knob assembly 101. The cover 130 may form a disk-like shape and include a plurality of outer arcs 113 spaced from one another. When assembled, an edge 115 of each arc 113 may extend the outer periphery 107 of the knob 102. The spaces between the arcs 113 may from arc openings 117. The cover 130 may include a center support 120 arranged in the center of the cover 130 and define a central bore 123. The center support 120 may be raised and have a higher profile than the arcs 113. The center support 120 may also have a higher profile, at least in areas, than the inner lock ring 132. This is discussed further herein.

The cover 130 may form a center ring 124 between the center support 120 and the arcs 113. The center ring 124 connects the center support 120 to the arcs 113 and may be recessed compared to the arcs 113 and center support 120. The center support 120 defines a cover chamfered region 128 defining a sloped incline 129 and a cover opening 131. In the assembled state, the center support 120 support receives the inner lock ring 132 and maintains the ring 132 therein while allowing the ring to rotate freely within the center support 120.

Figure 5:
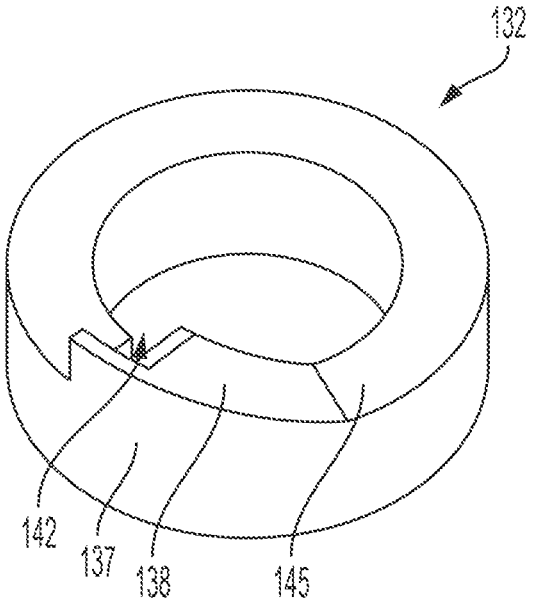
FIG. 5 illustrates a perspective view of an example inner lock ring of the knob assembly.

FIG. 5 illustrates a perspective view of the example inner lock ring 132 of the knob assembly 101. The inner lock ring 132 may be a hollow ring forming a center opening. The ring 132 may form a ring chamfered region 137. The ring chamfered region 137 defines a sloped incline portion 138 extending to a ring opening 142. The ring opening 142 is configured to receive the projection flap 108 of the knob 102 when the knob 102 is rotated. The sloped incline portion 138 extends from the ring opening 142 to a stop 145. The stop 145 is configured to abut the projection flap 108 and rotate the inner lock ring in response to rotation of the projection flap 108. That is, the incline portion 138 creates a frictional resistance on the projection flap 108 as the flap 108 slides along the incline portion 138. Once the flap 108 has been rotated through this intermediate position, he flap 108 abuts the stop 145. Further rotation of the flap 108 then causes the ring 132 to rotate with the knob 102 until a desired gas release is achieved by the user.

During assembly, the inner lock ring 132 may be received by the cover such that the ring 132 is seated within the center support 120 of the cover 130. The cover chamfered region 128 and the ring chamfered region 137, as well as the ring opening 142 and the cover opening 131 align. When the ring chamfered region 137 receives the projection flap 108 of the knob 102, rotation of the knob 102 may cause rotation of the ring 132. As explained, the ring 132 may move freely within the center support 120. The cover 130 maintains a fixed position while the ring 132 freely rotates. The cover incline portion 129 may abut the ring incline portion 138, forcing the ring 132 to move downward as the ring 132 rotates through the channel created by the center support 120. This is described in more detail herein. The ring 132 may be made of sheet metal, injected metal, plastic, or any other suitable material.

Figure 6:
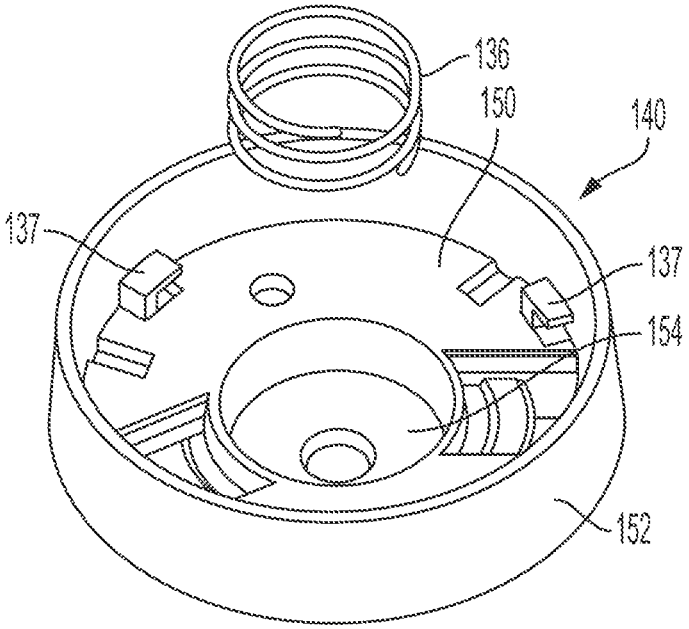
FIG. 6 illustrates a perspective view of an example spring and bezel of the knob assembly.

FIG. 6 illustrates a perspective view of the example spring 134 and bezel 140 of the knob assembly 101. The spring 134 may be a torsion spring or coiled spring configured to impart force in an opposite direction in response to compression of the spring 136. The bezel 140, similar to the cover 130 and inner lock ring 132, may form a disc-like shape having a base 150 and a lip 152 around the outer periphery. The base 150 may have a recessed portion 154 at the center of the base 150. The recessed portion 154 is configured to receive the spring 134. The recessed portion 154 may form a cylindrical-shaped opening having a diameter similar to that of the spring 134.

A plurality of notches 156 may extend from the base. Each notch 156 may create a space between the notch 156 and the base and be configured to lock a portion of one of the arcs 113 of the cover 130 into the space. For example, during assembly, the cover 130 may be placed within the bezel 140. The arc openings 117 of the cover 130 may receive the notches 156. Once seated in the bezel 140, the cover 130 may be rotated so that the notches 156 slide over the arcs 113, thus locking the cover 130 within the bezel 140. This aids in maintaining the cover 130 in a fixed position when the ring 132 is rotated.

Figure 7:
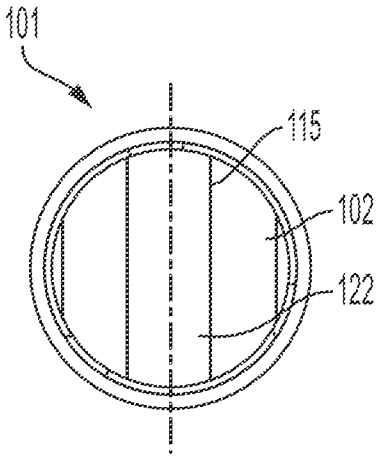
FIG. 7 illustrates a top view of an example knob assembly for a knob of the cooktop of FIG. 1, where the knob is in a resting position.

FIG. 7 illustrates a top view of the example knob assembly 101 for a knob 102 of the cooktop of FIG. 1, where the knob 102 is in a resting position. In the resting position, the knob 102 may be the first position with the interface 122 aligned along an axis indicating that the gas release is OFF. The knob 102 may be seated within the bezel 140 such that the lip 152 of the bezel 140 surrounds the outer periphery 107 of the knob 102. Further, the bezel 140 may receive the cover 130 such that the edges 115 of the arcs 113 of the cover 130 abut an inside surface of the lip 152 of the bezel 140. The edges 115 may also engage the outer periphery 107 of the knob. Thus, as evident in FIG. 7, the knob 102 may be seated on the cover 130 and within the bezel 140.

Figure 8:
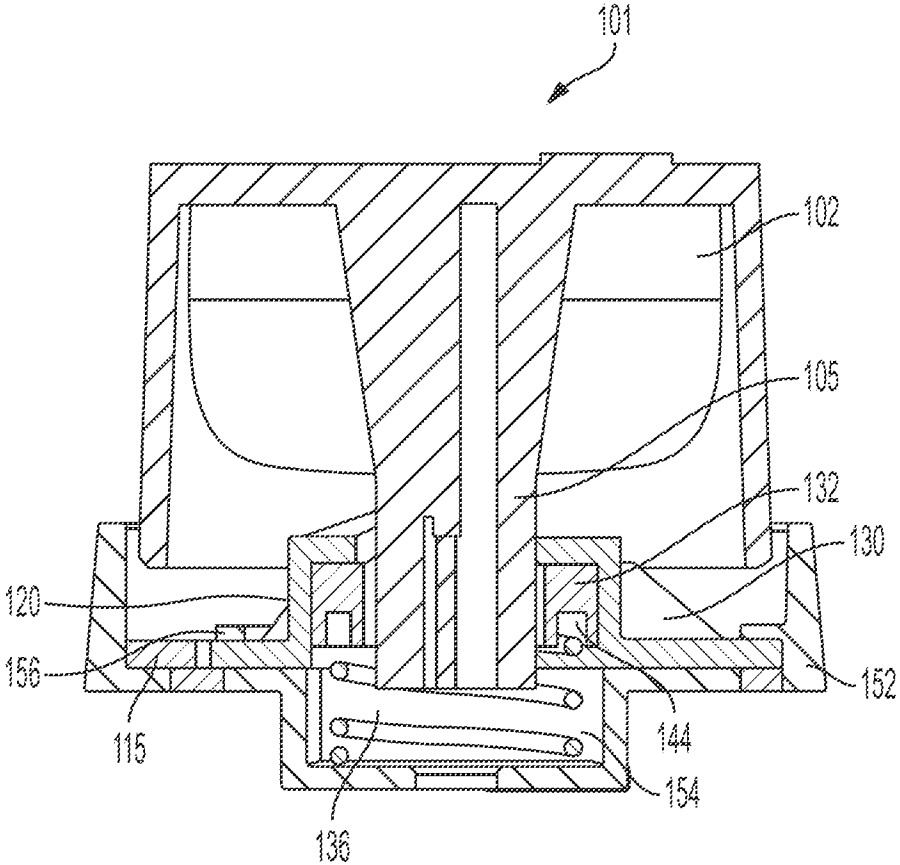
FIG. 8 illustrates a cross sectional view of the knob assembly of FIG. 7.

FIG. 8 illustrates a cross sectional view of the knob assembly of FIG. 7. As explained above, the knob 102 may be seated within the bezel 140 such that the lip 152 of the bezel 140 surrounds the outer periphery 107 of the knob 102. Further, the bezel 140 may receive the cover 130 such that the edges 115 of the arcs 113 of the cover 130 abut an inside surface of the lip 152 of the bezel 140. The inner lock ring 132 is received within the center support 120 of the cover 130. The inner lock ring 132 may form a circular indentation 144 at its underside and be configured to receive at least a portion of the spring 134. This indentation may maintain the spring 134 within the ring 132 and allow the force to be applied to the ring 132, forcing the ring 132 upward against the cover 130.

The cover 130, once seated within the bezel, may secure the spring 134 within the recessed portion 154 of the bezel 140 by closing off the recessed portion 154. The spring 134 may engage with the underside of the inner lock ring 132 and provide the bias force. This force may be translated through the cover 130 and ring 132 and onto the knob 102, forcing the knob in the first, or elevated position. The projection flap 108 is not visible in FIG. 10, but is understood to be arranged above the cover 130 in the resting position.

In this resting position, should the knob 102 be turned, bumped, etc., the spring 136 will impart the bias force F to return the knob back to the normal elevated position. Gas will not be released, and the bias may ensure that any depression and rotation of the knob are deliberate and release of gas is in response to actuations are not accidental.

Figure 9:
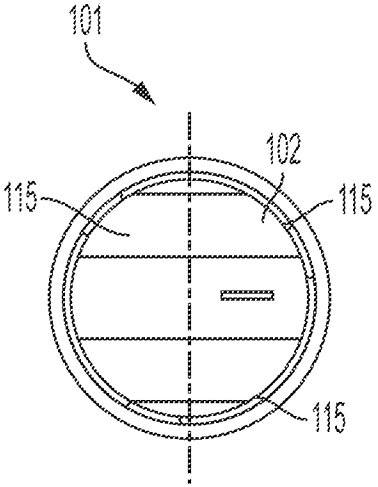
FIG. 9 illustrates a top view of an example knob assembly for a knob of the cooktop of FIG. 1, where the knob is in an intermediate position.

FIG. 9 illustrates a top view of the example knob assembly 101 for a knob 102 of the cooktop of FIG. 1, where the knob 102 is in an intermediate position. Similar to FIG. 7, the knob 102 may be seated within the bezel 140 such that the lip 152 of the bezel 140 surrounds the outer periphery 107 of the knob 102. Further, the bezel 140 may receive the cover 130 such that the edges 115 of the arcs 113 of the cover 130 abut an inside surface of the lip 152 of the bezel 140. The edges 115 may also engage the outer periphery 107 of the knob. In the intermediate position, the interface 122 of the knob 102 may be aligned perpendicular to the axis. The knob 102 may be rotated 90 degrees to this position, though more or fewer degrees of rotation may be appreciated. In this position, the gas may initiate release and the user may hear a clicking sound indicating that the gas release is initiated. In order for this to occur, the user may both press down on the knob 102, as well as rotate the knob 102.

Figure 10:
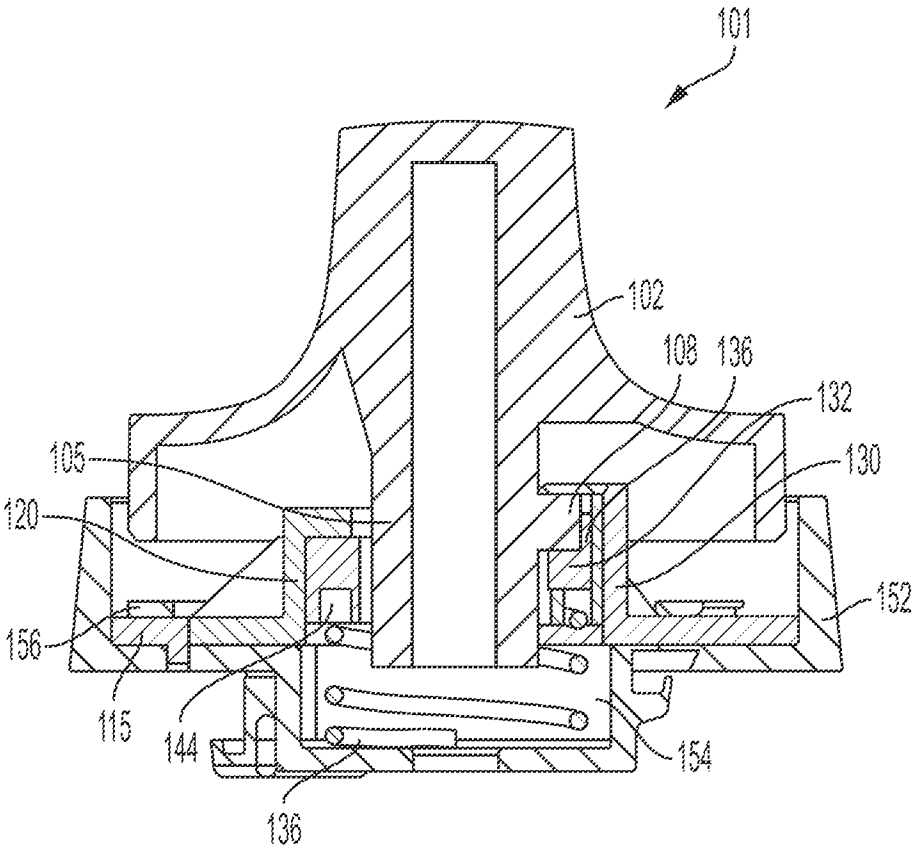
FIG. 10 illustrates a cross sectional view of the knob assembly of FIG. 9.

FIG. 10 illustrates a cross sectional view of the knob assembly of FIG. 9. In this intermediate position, the knob 102 is pressed further into the bezel 140. The spring 134 provides resistance to this force and ensures that the depression of the knob 102 was deliberate by the user. Again, similar to the resting position, the knob 102 may be seated within the bezel 140 such that the lip 152 of the bezel 140 surrounds the outer periphery 107 of the knob 102. Further, the bezel 140 may receive the cover 130 such that the edges 115 of the arcs 113 of the cover 130 abut an inside surface of the lip 152 of the bezel 140. The inner lock ring 132 is received within the center support 120 of the cover 130.

When the knob 102 is pressed, the knob 102 may move vertically lower within the bezel 140 and the support cylinder 105 moves within central bore 123 of the cover 130. Accordingly, the projection flap 108 may also move vertically lower with respect to the cover 130. By moving the knob 102, and subsequently the projection flap 108 downward, the projection flap 108 may be subsequently aligned with the cover opening 131 at the chamfered region 128 of the cover 130. As explained above, the chamfered region 137 of the inner lock ring 132 is seated inside the chamfered region 128 of the cover 130. The ring opening 142 aligns with the cover opening 131 to allow the projection flap 108 to be received therein.

Similarly, the sloped incline 129 of the cover 130 aligns with the sloped incline portion 138 of the ring 132. When the knob 102 is first depressed, the projection flap 108 is moved downward such that the projection is received within the cover opening 131 and the ring opening 142. Should the knob 102 be released at this point, the spring 136 would bias the knob 102 upwards and return the knob 102 to the resting position. However, should the user continue to press down on the knob 102, as well as begin to rotate the knob 102, the projection flap 108 also rotates into the chamfered region 137 of the ring 132. The sloped incline portion 138 of the chamfered region 137 forces the projection to gradually descend further, guiding the projection flap 108 through the ring as the knob 102 continues to rotate.

The friction created between the projection flap 108 and the ring incline portion 138 is increased by the bias force created by the spring 136. The spring 136 is forcing the projection flap 108 upwards, while the rotation of the knob 102 is forcing the projection to slide down the incline portion 138 and into the ring 132. This friction creates a resistance recognizable at the knob 102 and by the user. This helps to ensure that any rotation of the knob 102 is intentional, and that the user does in fact wish to initiate the release of gas. This portion of the rotation is referred to herein as the intermediate position, where the rotational force required to continue to rotate the knob 102 is greater than any other rotational position.

Once the knob 102 is rotated such that the projection flap 108 has navigated through the chamfered region 137, the projection flap 108 may abut the stop 145 and rotate more freely. This allows the user to rotate the knob 102 to the desired gas release level without the additional resistance created by the chamfered region 137.

Again, if the rotation of the knob 102 was accidental, the spring 136 and chamfered region 137 will impart a force to return the knob 102 back to the normal or resting position. If the rotation was done on purpose by a user, the user will continue to fight against the resistance and rotate the knob 102 until the projection flap 108 engages the inner lock ring 132 and the spark starts to produce a sound and gas is flowing to the burner. After rotating past the intermediate position, the knob 102 may move freely to allow the user to select the desired position of the knob 102 for the desired gas flow.

Accordingly, a controllable knob 102 is disclosed that prevents inadvertent actuation from releasing gas accidentally. The inner lock ring slides along the incline portion of the cover in response of subsequent rotation of the knob, the incline portion imparting a torque resistance, due to spring action, on the inner lock and the knob to prevent against unintentional rotation of the knob.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

What is claimed is:

1. A knob assembly for a gas cooktop, comprising:

a knob configured to control a flow of gas from a burner of a cooktop starting at a resting position, the knob defining a hollow interior and having a support cylinder extending vertically through the hollow interior, wherein the support cylinder includes a projection flap protruding therefrom; and an inner lock ring arranged at least partially within the hollow interior of the knob and having a chamfered region defining a ring opening adjacent a sloped incline portion, where the opening is configured to selectively receive the projection flap in response to depression of the knob and where the projection flap slides along the incline portion of the inner lock ring in response of subsequent rotation of the knob, the incline portion imparting a torque resistance, due to spring action, on the inner lock to prevent against unintentional rotation of the knob.

2. The assembly of claim 1, where the incline portion extends between the ring opening and a stop, the stop configured to abut the projection flap and rotate the inner lock ring in response to rotation of the projection flap.

3. The assembly of claim 1, further comprising a bezel configured to receive at least a portion of the ring and at least a portion of the knob, and defining a base surrounded by a lip.

4. The assembly of claim 3, wherein the lip is configured to surround an outer periphery of the knob and define a recessed portion.

5. The assembly of claim 4, a spring arranged in the recessed portion of the base and configured to impart a bias force against the inner lock ring to maintain the ring in the resting position when the projection flap is not arranged within the ring opening.

6. The assembly of claim 5, wherein the spring is configured to increase the reaction between the inclined portion of the inner lock ring and the inclined portion of the projection flap.

7. The assembly of claim 5, further comprising a cover having a center support configured to receive the inner lock ring therein, the cover arranged within the bezel and configured to maintain the spring in the recessed portion.

8. The assembly of claim 7, where the center support includes a cover opening configured to align with the ring opening for receiving the projection flap.

9. The assembly of claim 7, where the center support has a cover chamfered region having the incline portion.

10. The assembly of claim 7, where the cover includes a plurality of arcs around an outer perimeter configured to engage with a notch arranged on the base of the cover to maintain the cover in a fixed position relative to the base so that the inner lock ring rotates in response to the knob rotating while cover maintains a fixed position on the bezel.

11. A knob assembly for a gas cooktop, comprising:

a knob configured to control a flow of gas from a burner of a cooktop starting at a resting position, the knob defining a hollow interior and a projection flap protruding therefrom, the projection flap configured to move vertically and rotationally with the knob; and an inner lock ring arranged at least partially within the hollow interior of the knob and having a chamfered region defining a ring opening adjacent a sloped incline portion, the opening configured to selectively receive the projection flap in response to depression of the knob and where the projection flap slides along the incline portion in response to subsequent rotation of the knob, the incline portion creating an intermediate position for the knob to prevent against unintentional rotation of the knob.

12. The assembly of claim 11, where the incline portion extends between the ring opening and a stop, the stop configured to abut the projection flap and rotate the inner lock ring in response to continued rotation of the projection flap.

13. The assembly of claim 11, further comprising a bezel configured to receive at least a portion of the ring and at least a portion of the knob, and defining a base surrounded by a lip.

14. The assembly of claim 13, wherein the lip is configured to surround an outer periphery of the knob and defines a recessed portion.

15. The assembly of claim 14, a spring arranged in the recessed portion of the base and configured to impart a bias force against the inner lock ring to maintain the ring in the resting position when the projection flap is not arranged within the incline portion of the ring.

16. The assembly of claim 15, wherein the spring is configured to impart and increase frictional resistance between the projection flap and the incline portion.

17. The assembly of claim 15, further comprising a cover having a center support configured to receive the inner lock ring therein, the cover arranged within the bezel and configured to maintain the spring in the recessed portion.

18. The assembly of claim 17, where the center support includes a cover opening configured to align with the ring opening for receiving the projection flap.

19. The assembly of claim 17, where the central support has a cover chamfered region having an incline portion.

20. The assembly of claim 17, where the cover includes a plurality of arcs around an outer perimeter configured to engage with a notch arranged on the base of the cover to maintain the cover in a fixed position relative to the base so that the inner lock ring rotates in response to the knob rotating while the cover maintains a fixed position on the bezel.

* * * * *